US011749106B2

(12) United States Patent
Lamoncha

(10) Patent No.: US 11,749,106 B2
(45) Date of Patent: Sep. 5, 2023

(54) STOP SIGN WITH TRAFFIC CONTROL FEATURES

(71) Applicant: Mark Lamoncha, Columbiana, OH (US)

(72) Inventor: Mark Lamoncha, Columbiana, OH (US)

( * ) Notice: Subject to any disclaimer, the term of this patent is extended or adjusted under 35 U.S.C. 154(b) by 259 days.

(21) Appl. No.: 17/246,031

(22) Filed: Apr. 30, 2021

(65) Prior Publication Data

US 2021/0264774 A1 Aug. 26, 2021

Related U.S. Application Data

(63) Continuation-in-part of application No. 17/201,266, filed on Mar. 15, 2021, now Pat. No. 11,605,291, which is a continuation-in-part of application No. 17/158,365, filed on Jan. 26, 2021, which is a continuation of application No. 16/682,723, filed on Nov. 13, 2019, now Pat. No. 10,937,309.

(60) Provisional application No. 62/769,034, filed on Nov. 19, 2018.

(51) Int. Cl.

| | |
|---|---|
| ***G08G 1/01*** | (2006.01) |
| ***G08G 1/04*** | (2006.01) |
| ***G08G 1/085*** | (2006.01) |

(52) U.S. Cl.

CPC ..... *G08G 1/0116* (2013.01); *G08G 1/04* (2013.01); *G08G 1/085* (2013.01)

(58) Field of Classification Search

None

See application file for complete search history.

(56) References Cited

U.S. PATENT DOCUMENTS 2,941,099 A * 6/1960 Picard ..... H01J 41/06 315/108
4,211,382 A * 7/1980 Bonfils ..... A47G 1/168 248/494

(Continued)

FOREIGN PATENT DOCUMENTS

| | | |
|---|---|---|
| CA | 3047398 A1 | 6/2018 |
| FR | 3022673 A1 | 12/2015 |
| FR | 3040104 A1 | 2/2017 |

OTHER PUBLICATIONS

Evelots Flashing LED Auto Parking Signal, Amazon.com, site visited Aug. 21, 2018.

(Continued)

*Primary Examiner* — Fekadeselassie Girma
(74) *Attorney, Agent, or Firm* — Standley Law Group LLP; Jeffrey S. Standley; Adam J. Smith

(57) ABSTRACT

Systems and methods for controlling traffic at an intersection are provided. A controller receives data from a vehicle detection device indicating a presence or non-presence of vehicles within a first area forward or adjacent to the stop sign. The controller receives data from a cross-traffic vehicle detection device indicating a presence or non-presence of vehicles within a second area rearward of the stop sign. Where data is received indicating the presence of at least one vehicle within the first area and the non-presence of any vehicles within the second area, the controller commands a traffic signaling device for the stop sign to temporarily cease providing the wait signal and instead provide the proceed signal.

19 Claims, 15 Drawing Sheets

(56) References Cited

U.S. PATENT DOCUMENTS

| | | | | |
|---|---|---|---|---|
| 4,216,989 | A * | 8/1980 | Tackett | B60J 11/00 296/136.04 |
| 5,673,039 | A | 9/1997 | Pietzsch et al. | |
| 6,243,644 | B1 | 6/2001 | Dengler | |
| 6,580,374 | B2 | 6/2003 | Schrage | |
| 6,693,556 | B1 | 2/2004 | Jones et al. | |
| 7,075,427 | B1 | 7/2006 | Pace et al. | |
| 7,371,348 | B2 * | 5/2008 | Schleifer | B01L 3/5085 264/494 |
| 7,696,903 | B2 | 4/2010 | Stam et al. | |
| 8,442,750 | B1 | 5/2013 | Tran et al. | |
| 8,793,062 | B2 | 7/2014 | Fino | |
| 9,198,605 | B2 * | 12/2015 | Contant | A61B 5/1123 |
| 9,550,498 | B2 | 1/2017 | Meyer et al. | |
| 10,055,986 | B2 | 8/2018 | Paruch et al. | |
| 10,095,320 | B2 * | 10/2018 | Harms | G06F 3/023 |
| 10,173,292 | B2 * | 1/2019 | Fullerton | B23P 15/001 |
| 10,176,712 | B1 * | 1/2019 | Martins | G08G 1/07 |
| 10,211,872 | B1 * | 2/2019 | Diebel | H05K 5/03 |
| 10,242,783 | B2 * | 3/2019 | Smith | H02K 21/24 |
| 10,403,142 | B1 * | 9/2019 | Shuff | G08G 1/095 |
| 10,650,672 | B2 | 5/2020 | Shuff | |
| 10,937,309 | B2 | 3/2021 | Lamoncha | |
| 10,998,735 | B2 * | 5/2021 | Chien | G09F 23/00 |
| 11,598,146 | B2 * | 3/2023 | Conboy | E06B 9/386 |
| 2004/0183694 | A1 | 9/2004 | Bauer | |
| 2009/0224942 | A1 * | 9/2009 | Goudy | G08G 1/164 340/905 |
| 2010/0062866 | A1 * | 3/2010 | Schnuckle | A63G 31/16 472/78 |
| 2010/0283631 | A1 | 11/2010 | Bryan | |
| 2011/0283574 | A1 * | 11/2011 | Ellman | B60R 13/10 40/209 |
| 2012/0175859 | A1 | 7/2012 | Roth, Jr. | |
| 2013/0100286 | A1 | 4/2013 | Lao | |
| 2014/0310243 | A1 * | 10/2014 | McGee | G06F 16/27 707/639 |
| 2015/0084369 | A1 | 3/2015 | Niemi | |
| 2016/0005313 | A1 | 1/2016 | Cholayil | |
| 2017/0046954 | A1 | 2/2017 | Eversen | |
| 2017/0103650 | A1 | 4/2017 | Amadon | |
| 2018/0103240 | A1 | 4/2018 | Barnes | |
| 2019/0035263 | A1 | 1/2019 | Loes | |
| 2019/0206254 | A1 | 7/2019 | Tao et al. | |
| 2019/0279508 | A1 | 9/2019 | Wang | |
| 2020/0005634 | A1 * | 1/2020 | Shuff | G08G 1/095 |
| 2020/0096977 | A1 | 3/2020 | Itou et al. | |
| 2021/0150891 | A1 | 5/2021 | Lamoncha | |
| 2021/0201663 | A1 * | 7/2021 | Lamoncha | G08G 1/04 |
| 2021/0264774 | A1 | 8/2021 | Lamoncha | |
| 2021/0284254 | A1 * | 9/2021 | Vanga | B62D 37/02 |
| 2021/0311137 | A1 * | 10/2021 | Chen | G01D 5/145 |
| 2022/0305919 | A1 * | 9/2022 | Grayson | B60L 50/62 |
| 2022/0379924 | A1 * | 12/2022 | Foster | B60W 30/16 |
| 2022/0389932 | A1 * | 12/2022 | Wu | F04D 29/051 |
| 2023/0036694 | A1 * | 2/2023 | Coughlan | G06Q 20/38215 |

OTHER PUBLICATIONS

PerfectStop Sign—Intelligent Stop Sign System, www.indiegogo.com, site visited Aug. 21, 2018.

Safe-T-Signal Warning System, www.ritehite.com, site visited Aug. 21, 2018.

* cited by examiner

STOP SIGN WITH TRAFFIC CONTROL FEATURES

CROSS-REFERENCE TO RELATED APPLICATION

This application is a continuation-in-part of U.S. application Ser. No. 17/201,266 filed Mar. 15, 2021, which is a continuation-in-part of U.S. application Ser. No. 17/158,365 filed Jan. 26, 2021, which is a continuation of U.S. application Ser. No. 16/682,723 filed Nov. 13, 2019, which claims the benefit of U.S. Provisional Application No. 62/769,034 filed Nov. 19, 2018, the disclosures of each of which are hereby incorporated by reference as if fully restated herein.

TECHNICAL FIELD

Exemplary embodiments of the present invention relate generally to systems and methods for controlling traffic using a stop sign with traffic control features.

BACKGROUND AND SUMMARY OF THE INVENTION

Traffic congestion is frequently caused by roadway intersections. Traffic often becomes backed up at intersections where conventional stop signs are used to control traffic because drivers are unsure of which driver has the right of way to cross the intersection first. Furthermore, traffic collisions often occur when one driver proceeds despite not having the right of way. While traffic lights can provide for improved traffic flow and reduced accidents, they are too expensive to install at every intersection. Furthermore, stop signs are not adaptable to changing traffic conditions.

Therefore, what is needed is stop sign with traffic control features. The present invention is a stop sign with traffic control features.

An assembly may comprise a conventional stop sign, which may be mounted to a post, pole, or the like. A traffic control unit may comprise one or more signaling devices which direct the driver of a nearby vehicle to proceed or wait. A vehicle detection device may detect vehicles located at or near the assembly. A controller may receive information from the vehicle detection device and direct the traffic control unit. The controller may receive instructions from a central command unit. The central command unit may be in communication with several or all assemblies for a given intersection. A power supply, such as a solar panel, may be electrically connected with various components of the assembly to provide power to the same.

The assembly may continuously scan for the arrival of a vehicle. Once a vehicle is detected, the assembly may note the arrival time and transmit the arrival time to the command center. The command center may determine if an earlier arrival time within a predetermined amount of time has been logged by the same or a different assembly for an intersection. If not, the command center may direct the respective assembly to set its traffic signaling device to proceed. If not, the system may wait until the predetermined time is reached and then direct the respective assembly to set its traffic signaling device to proceed.

Distracted drivers may not always notice a stop sign or a traffic signal indicated at a traffic signaling device. This may result in running of red lights, running of stop signs, or collisions. Even where there is merely a delay by the distracted driver in noticing a changing traffic signal, traffic delays, confusion for other drivers, and the like may result. In some cases, it may be safer to override or control the vehicle's advancement in turn through the intersection. Therefore, what is needed is the ability to communicate traffic signals and changes to drivers within their vehicles, and/or override driver actions or otherwise autonomously control vehicle movements based on such signals.

Systems and methods are disclosed for communicating traffic signals to a driver of a vehicle using certain systems located within a vehicle. Vehicles equipped with vehicle-based systems may wirelessly communicate with one or more assemblies and/or the command center. The vehicle-based systems may communicate an identifier for the vehicle which may be used to track which vehicle-based system to send proceed and wait signals to. Upon receipt of a proceed signal or a wait signal, the vehicle-based system may alert the driver to the same. If the driver attempts to proceed during a wait signal, the vehicle interface system may cause the vehicle to slow or stop. If the driver fails to proceed during a proceed signal, the vehicle-based system may further alert the driver to the proceed signal. Communication between the vehicle-based system and the assembly and/or the command center may be accomplished by one or more wireless communication devices.

The assemblies may be equipped to accommodate both vehicles having the vehicle-based systems, such as by way of wireless communication devices, and vehicles without the vehicle-based systems, such as by way of proximity sensors, cameras, combinations thereof, or the like.

In exemplary embodiments, without limitation, the upon receipt of a proceed signal, the vehicle-based system may command certain vehicle systems to advance the vehicle through the intersection autonomously by controlling certain vehicle systems. Upon receipt of a wait signal, the vehicle-based system may command certain vehicle systems to halt the vehicle.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
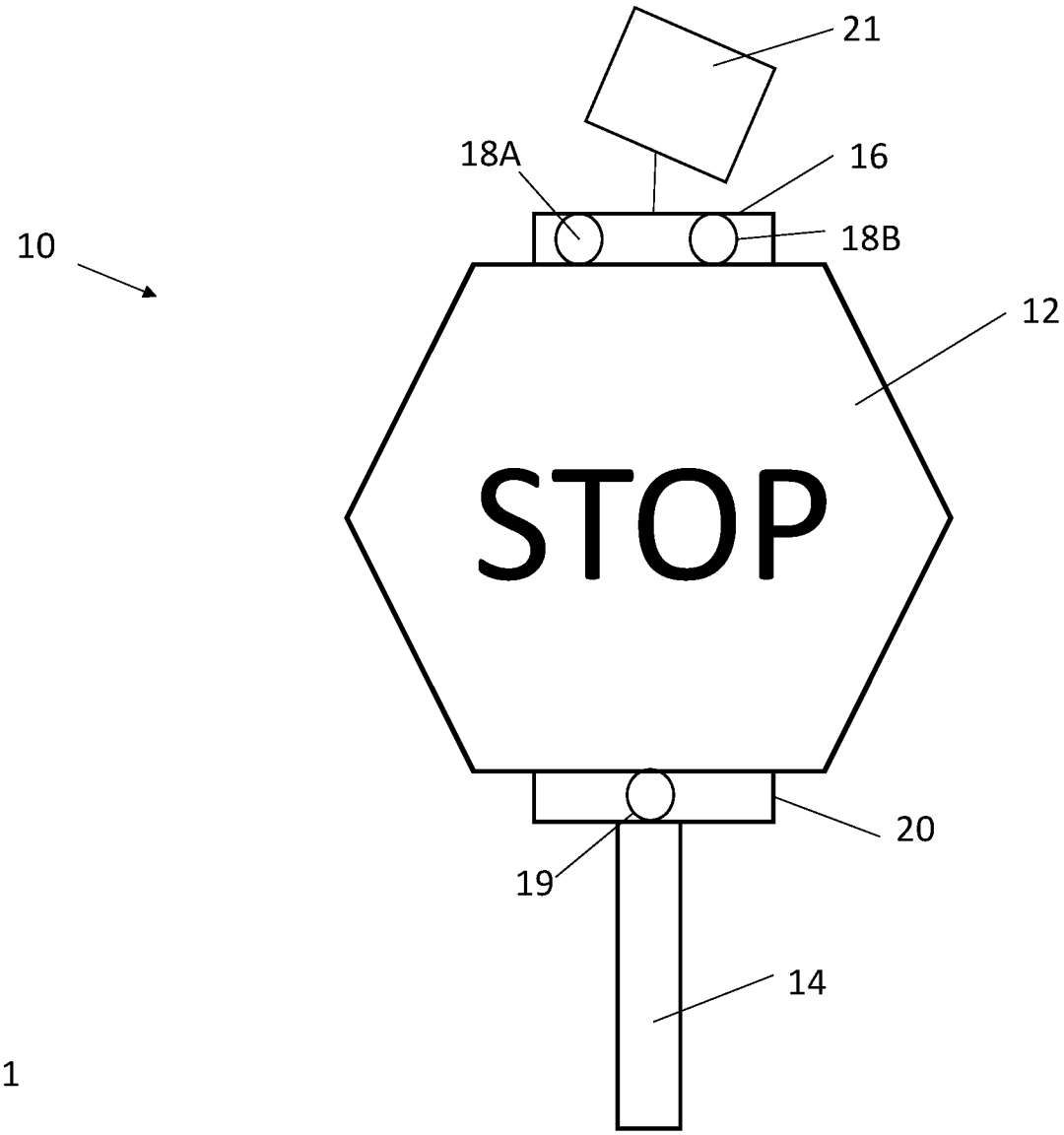
FIG. 1 is front view of an exemplary assembly in accordance with the present invention.

FIG. 1 is front view of an exemplary assembly 10 in accordance with the present invention. The assembly 10 may comprise a conventional stop sign 12. The stop sign 12 may be a static sign, a digital sign, some combination thereof, or the like. The stop sign 12 may be mounted to a mounting device 14. The mounting device 14 may comprise a post, pole, some combination thereof, or the like. The stop sign 12 may be mounted in any fashion, such as but not limited to, an overhead member, a wall, a stand, or the like.

The assembly 10 may comprise a traffic signaling device 16. The traffic signaling device 16 may comprise one or more signaling devices 18A and 18B configured to provide wait and proceed signals. In exemplary embodiments, the signaling devices 18A and 18B comprise one or more colored lights, such as but not limited to red (for wait) and green (for proceed), configured to be selectively illuminated to signal the driver of a vehicle 70 to proceed or to wait. However, any type of signaling devices 18A and 18B is contemplated, such as but not limited to, flags, signs, speakers for producing an audio signal, some combination thereof, or the like. Any number and type of signaling devices 18A and 18B are contemplated. The signaling devices 18A and 18B on various assemblies 10 may be the same or different types. The traffic signaling device 16 may be mounted to the assembly 10, such as above the stop sign 12 though any location is contemplated. In other exemplary embodiments, the traffic signaling device 16 may be located in close proximity with the assembly 10.

The assembly 10 may comprise a vehicle detection device 19. The vehicle detection device 19 may comprise one or more sensors configured to detect the presence of one or more vehicles 70. The vehicle detection devices 19 may comprise, for example without limitation, cameras, radar, lasers, motion detectors, light sensors, audio sensors, ultrasound sensors, infrared sensors, weight sensors, metal detectors, image recognition software, proximity detectors, some combination thereof, or the like. Alternatively, or in addition, the vehicle detection devices 19 may comprise far-range wireless communication devices such as, but not limited to, wi-fi, cellular network connectivity devices, internet connectivity devices, radio transmitters/receivers, network adapters, combinations thereof, or the like, and/or near field communication devices, such as but not limited to, RFID, Bluetooth®, combinations thereof or the like. The vehicle detection devices 19 may be configured to receive signals from devices installed in vehicles 70 within signaling range of such the vehicle detection devices 19. The vehicle detection device 19 may be mounted to the assembly 10. However, in other exemplary embodiments, the vehicle detection device 19 may instead be located in close proximity with the assembly 10.

The assembly 10 may further comprise a controller 20. The controller 20 may be in communication with one or more of the traffic signaling devices 16 and the vehicle detection device 19. The controller 20 may receive data from the vehicle detection device 19 and provide instructions to the traffic signaling device 16. As will be explained in greater detail, in exemplary embodiments the controller 20 is in communication with a command center 32. In such embodiments, the controller 20 may communicate information from the vehicle detection device 19 to the command center 32 and receive instructions from the command center 32, which may be relayed to the traffic signaling device 16.

The controller 20 may further comprise a time keeping device 28. The time keeping device 28 may be a clock, timing device, timer, some combination thereof, or the like. The time keeping device 28 may be in electronic communication with the processor 24. It is contemplated that the vehicle detection device 19 may alternatively or additionally comprise the time keeping device 28. Any location of the time keeping device 28 is contemplated.

The assembly 10 may further comprise a power source 21. The power source 21 may be in electrical connection with one or more of the traffic control unit 16, the vehicle detection device 19, and the controller 20. In exemplary embodiments, the power source 21 may comprise a solar panel. Alternatively, or in addition, the power source 21 may comprise one or more batteries. Alternatively, or in addition, the power source 21 may comprise a connector for connecting to utility power.

Figure 2:
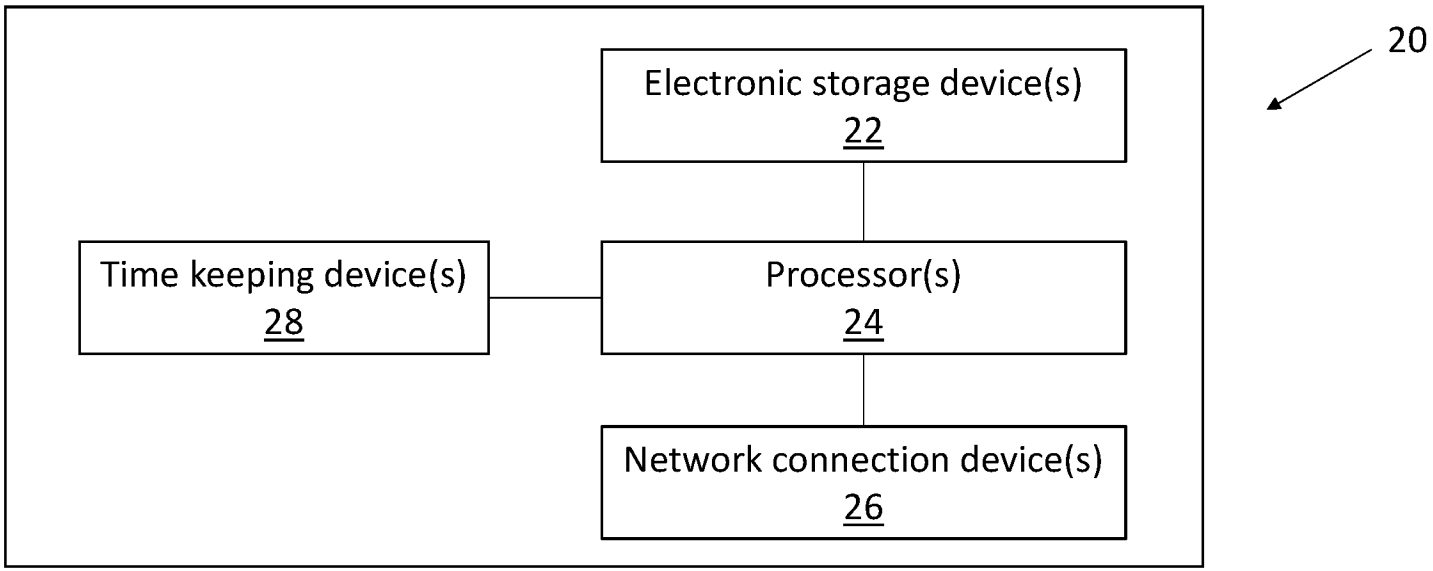
FIG. 2 is a simplified illustration of a controller.

FIG. 2 is a simplified illustration of the controller 20. The controller 20 may be in communication with the vehicle detection device 19 and the traffic signaling device 16. The controller 20, and various components thereof, may be electrically connected to the power supply 21. The controller 20 may comprise one or more electronic storage devices 22, processors 24, and network connection devices 26. The electronic storage device 22 may be configured to receive and store data from the vehicle detection device 19 and/or the controller 20. The electronic storage device 22 may further comprise executable software instructions, which when executed configure the processor 24 to perform one or more of the processes disclosed herein. The processor 24 may be configured to retrieve the data and/or executable software instructions stored at the electronic storage device 22. The network connection device 26 may be configured to transmit and receive data, such as but not limited to data stored at the electronic storage device 22, to the command center 32 and/or to other remote device(s). Such communication may be accomplished by way of a network such as the internet, intranet, cellular network, world wide web, or the like. Such communication may be accomplished by wired or wireless means.

Figure 3:
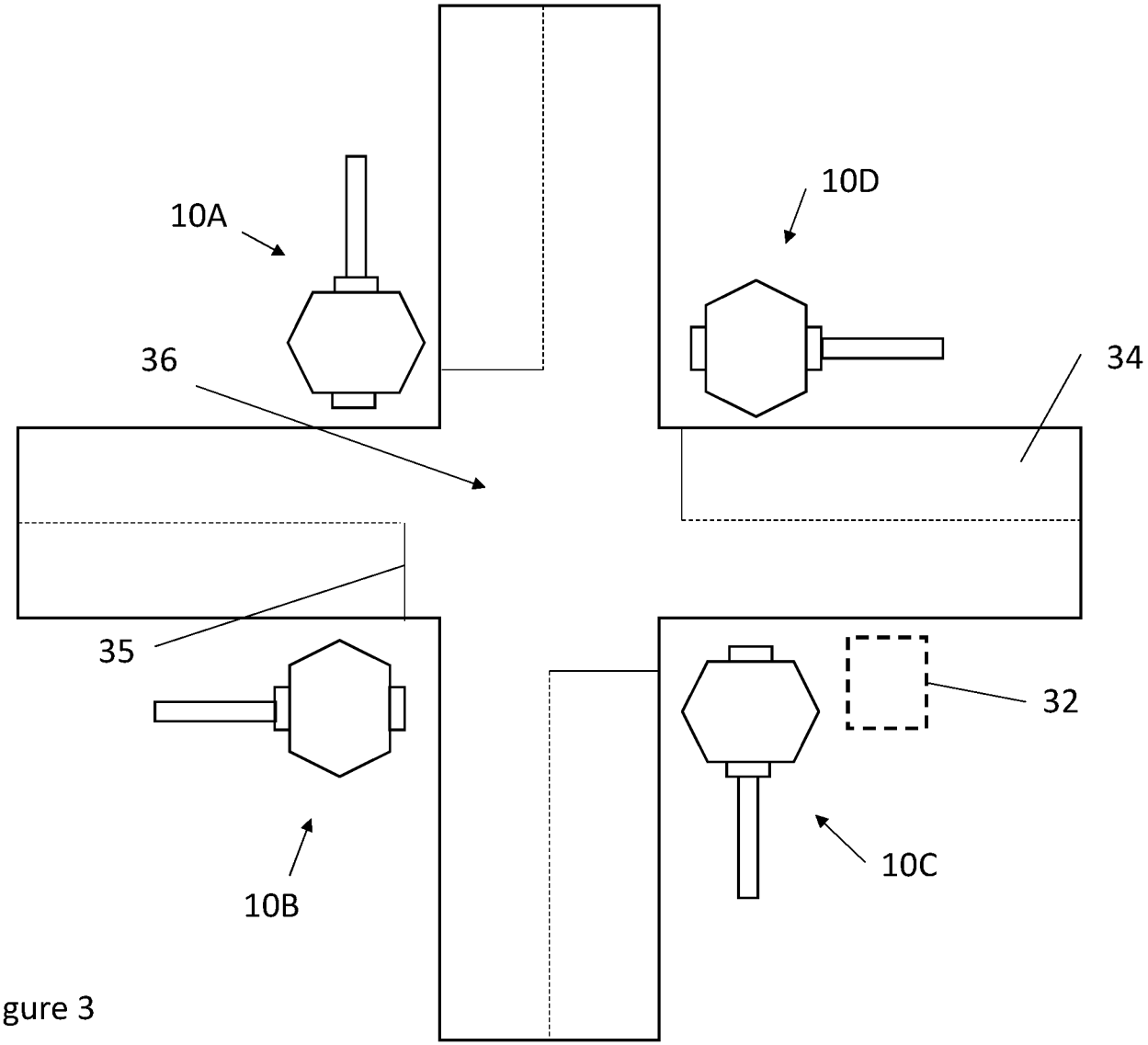
FIG. 3 is a top plan view of an exemplary intersection with multiple assemblies installed.

FIG. 3 is a top plan view of an exemplary intersection 36 with multiple assemblies 10 (e.g., 10A, B, C, D). More specifically, FIG. 3 illustrates a four-way intersection where two roads 34 intersect. Four assemblies 10 may be placed near the intersection 36 such that the flow of traffic is stopped in all four directions. However, any number of assemblies 10 may be utilized with any kind or type of intersection 36 with any number of roads 34. For example, without limitation, two assemblies 10 may be placed at a four way intersection, three assemblies 10 may be placed at a three way intersection, one assembly 10 may be placed at a three way intersection, and the like.

All of the assemblies 10 for a given intersection 36 may be in electronic communication with the command center 32 by way of a wired or wireless connection. In exemplary embodiments, the command center 32 may be buried near the respective intersection 36, though any location is contemplated. It is contemplated that assemblies 10 for more than one intersection 36 may be in communication with a common command center 32.

Figure 4:
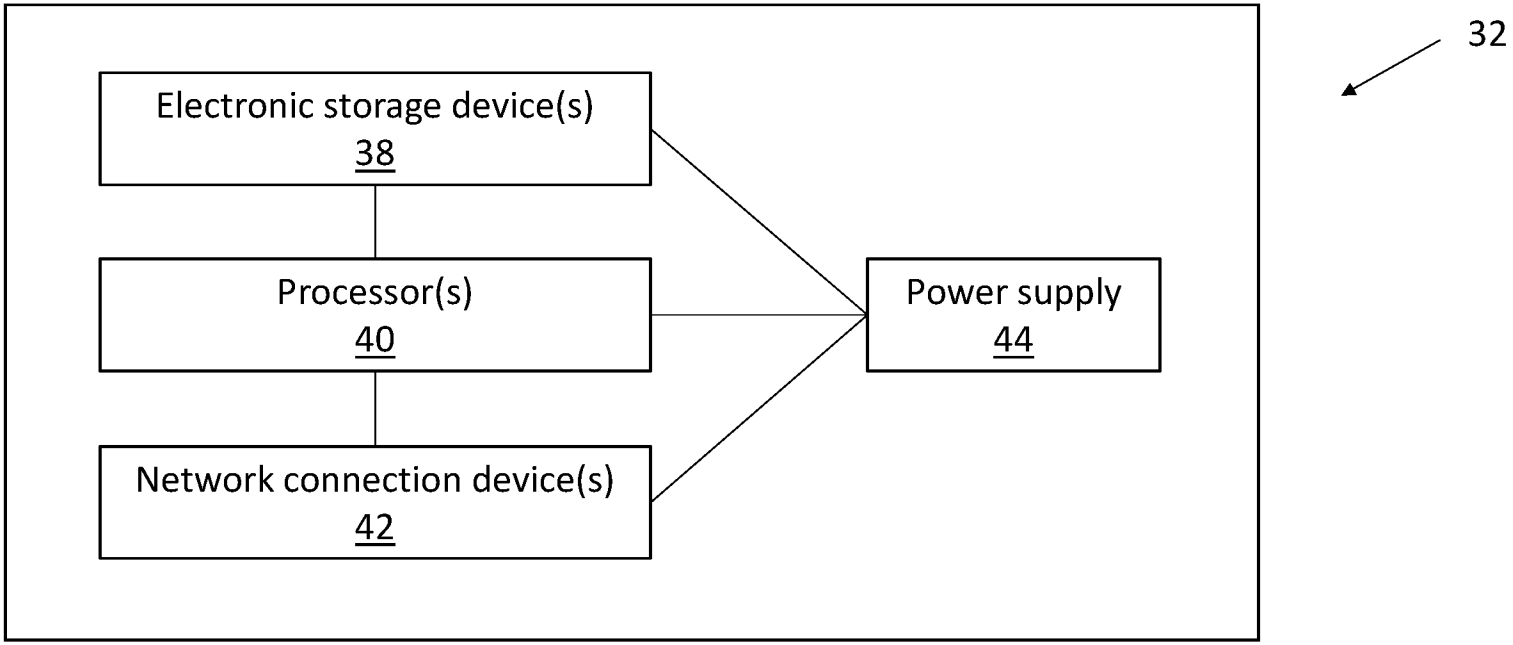
FIG. 4 is a simplified illustration of a command center.

FIG. 4 is a simplified illustration of the command center 32. The command center 32 may be in wired or wireless communication with the controller 20 of each assembly 10 for a particular intersection 36. The command center 32, and various components thereof, may be electrically connected to a power supply 44. The power supply 44 may comprise one or more batteries. Alternatively, or additionally, the power supply 44 may comprise a connector for connecting to a utility line. Alternatively, or in addition, the power supply 44 may comprise a solar panel, wind turbine, some combination thereof, or the like.

The command center 32 may comprise one or more electronic storage devices 38, processors 40, and network connection devices 42. The electronic storage device 38 may be configured to receive and store data from the various assemblies 10. The electronic storage device 38 may further comprise executable software instructions, which when executed configure the processor 40 to perform one or more of the processes disclosed herein. The processor 40 may be configured to retrieve the data and/or executable software instructions stored at the electronic storage device 38. The network connection device 42 may be configured to transmit and receive data, such as but not limited to data stored at the electronic storage device 38, to one or more of the controllers 20 for each assembly 10 and/or other remote device(s). Such communication may be accomplished by way of a network such as the internet, intranet, cellular network, world wide web, or the like. Such communication may be accomplished by wired or wireless means.

Figure 5:
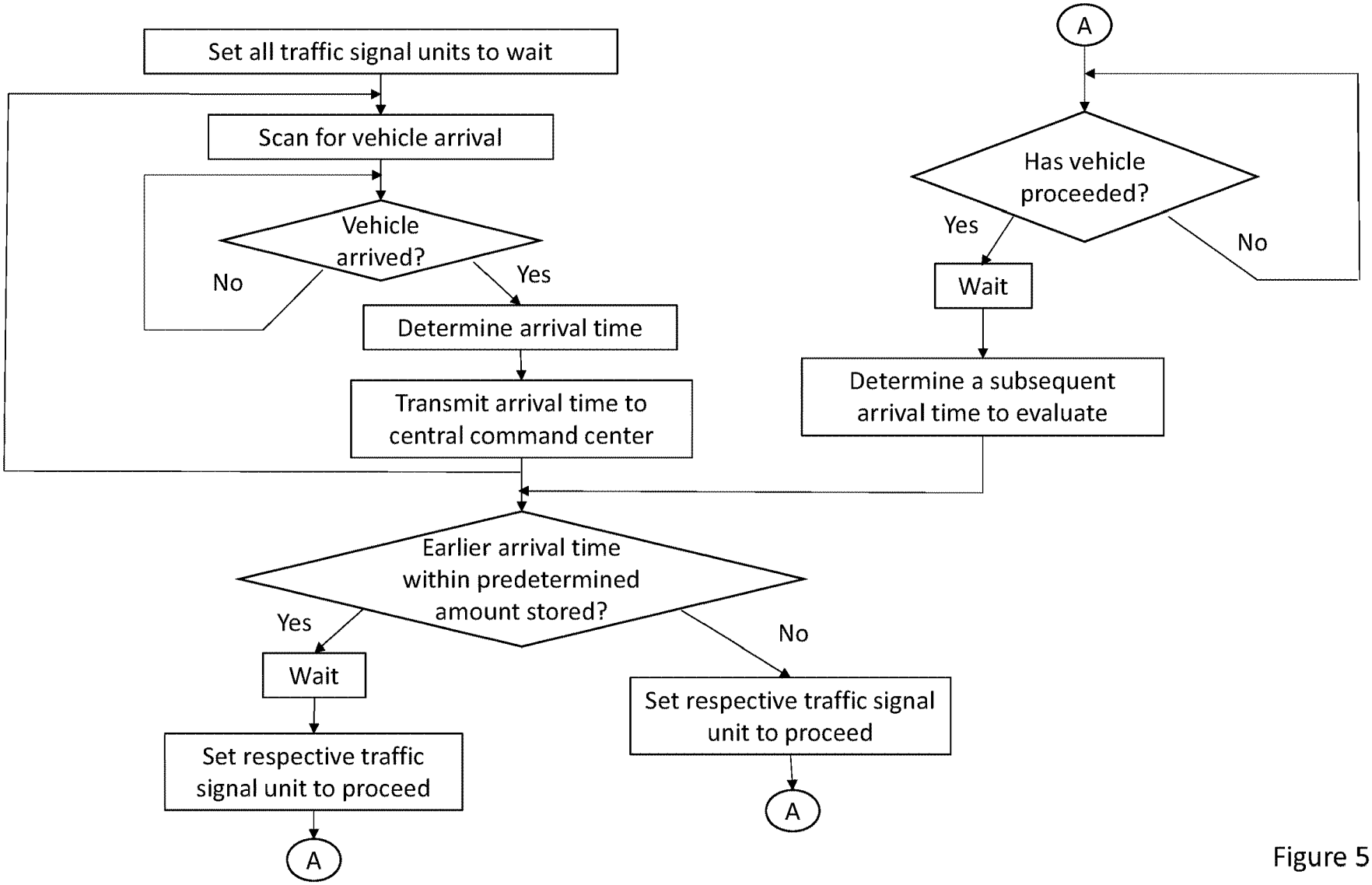
FIG. 5 is a flow chart with exemplary logic for operating the system of FIG. 3 in accordance with the present invention.

FIG. 5 is a flow chart with exemplary logic for operating a system of the assemblies 10 at an intersection 36, such as but not limited to, the intersection 36 shown and described with respect to FIG. 3. Initially, all of the traffic signaling devices 16 for all assemblies 10 for a particular intersection 36 may be set to wait. For example, without limitation, the traffic signaling device 16 may illuminate a red colored light. The vehicle detection devices 19 for all assemblies 10 for the particular intersection 36 may continuously scan for a vehicle's 70 arrival at the intersection 36. In exemplary embodiments, the vehicle detection devices 19 are configured to scan for vehicles 70 located at or near the stop line 35 associated with the respective assembly 10. For example, without limitation, the vehicle detection devices 19 may periodically, continuously, or at any interval take images of the intersection and use machine vision software to determine if a vehicle 70 is within the captured image. As another example, without limitation, the vehicle detection devices 19 may periodically, continuously, or at any interval transmit ultrasonic signals and determine if signals indicating the presence of a nearby vehicle 70 are received.

If no vehicle 70 is detected, the assemblies 10 may continue to scan. Once a vehicle 70 is detected, the respective assembly 10 may determine the vehicle's 70 arrival time at the time keeping device 28. The arrival time may be stored such as at the one or more electronic storage devices 22 of the controller 20. The arrival time may be transmitted to the command center 32. This communication, in exemplary embodiments, is made by way of the network connection device 26 in the respective assembly 10 and the network connection device 42 at the command center 32.

The command center 32 may determine if an earlier arrival time that is within a predetermined amount of time is stored at the electronic storage device 38 for the command center 32. The predetermined amount of time may be any amount of time. In exemplary embodiments, the predetermined amount of time is set such that a vehicle 70 may safely clear the intersection. The predetermined amount of time may be set from historical information.

If no earlier arrival time falling within the predetermined amount of time is found, the command center 32 may direct the respective assembly 10 to set the respective traffic signaling device 16 to proceed. For example, without limitation, the respective traffic signaling device 16 may illuminate a green colored light.

If an earlier arrival time falling within the predetermined amount of time is determined, the command center 32 may direct the respective assembly 10 to wait a sufficient amount of time such that the predetermined amount of time is reached and subsequently instruct the assembly 10 to set the respective traffic signaling device 16 to proceed. Alternatively, the command center 32 may wait until the predetermined amount of time is reached and subsequently direct the respective assembly 10 to set its respective traffic signaling device 16 to proceed.

The vehicle detection device 19 for the assembly 10 which was directed to set its traffic signaling device 16 to proceed may scan to ensure that the vehicle 70 signaled to proceed has actually proceeded. If the vehicle 70 has not proceeded, the vehicle detection device 19 may continue to scan until the vehicle 70 proceeds. In exemplary embodiments, the respective traffic signaling device 16 may take further action such as flashing a green light, emitting an audible tone, some combination thereof, or the like. Once the vehicle 70 has proceeded, a confirmation message regarding the same may be sent to the command center 32. The command center 32 may then evaluate the next earliest vehicle 70 arrival time, thereby repeating the process.

In other exemplary embodiments, once directing the respective traffic signaling device 16 to proceed, the command center 32 may wait a second predetermined amount of time before directing the next respective traffic signaling device 16 to proceed. The second predetermined amount of time may be the same or different as the predetermined amount of time. The second predetermined amount of time may be, for example without limitation, a certain multiple of the predetermined amount of time.

The command center 32 may then repeat the evaluation process for the next subsequently logged entry. In this way, the command center 32 evaluates and processes the arrival times in the order in which they occurred such that earlier arrival times are given priority.

It is notable that while the command center 32 is evaluating the arrival times, the assemblies 10 may be continuously scanning for vehicles 70, storing, and transmitting the arrival times to the command center 32. In this way, each vehicle's 70 arrival time may be logged and addressed in turn. If no additional vehicles 70 have arrived in the intervening time, the assemblies 10 may simply continue to scan for vehicles 70.

In exemplary embodiments, the vehicle detection device 19 may be capable of scanning the entire intersection 36 to determine when a vehicle 70 has cleared the intersection. In such embodiments, once the vehicle 70 has cleared the intersection, a confirmation message regarding the same may be sent to the command center 32. The command center 32 may then evaluate the next earliest vehicle 70 arrival time. Each vehicle detection device 19 may comprise multiple sensors of the same or different type which may scan the same or different areas.

In the unlikely event that two identical arrival times are determined, the command center 32 may randomly direct one of the two assemblies 10 to wait the predetermined amount of time and direct the other assembly 10 to set the respective traffic signaling device 16 to proceed.

Figure 6:
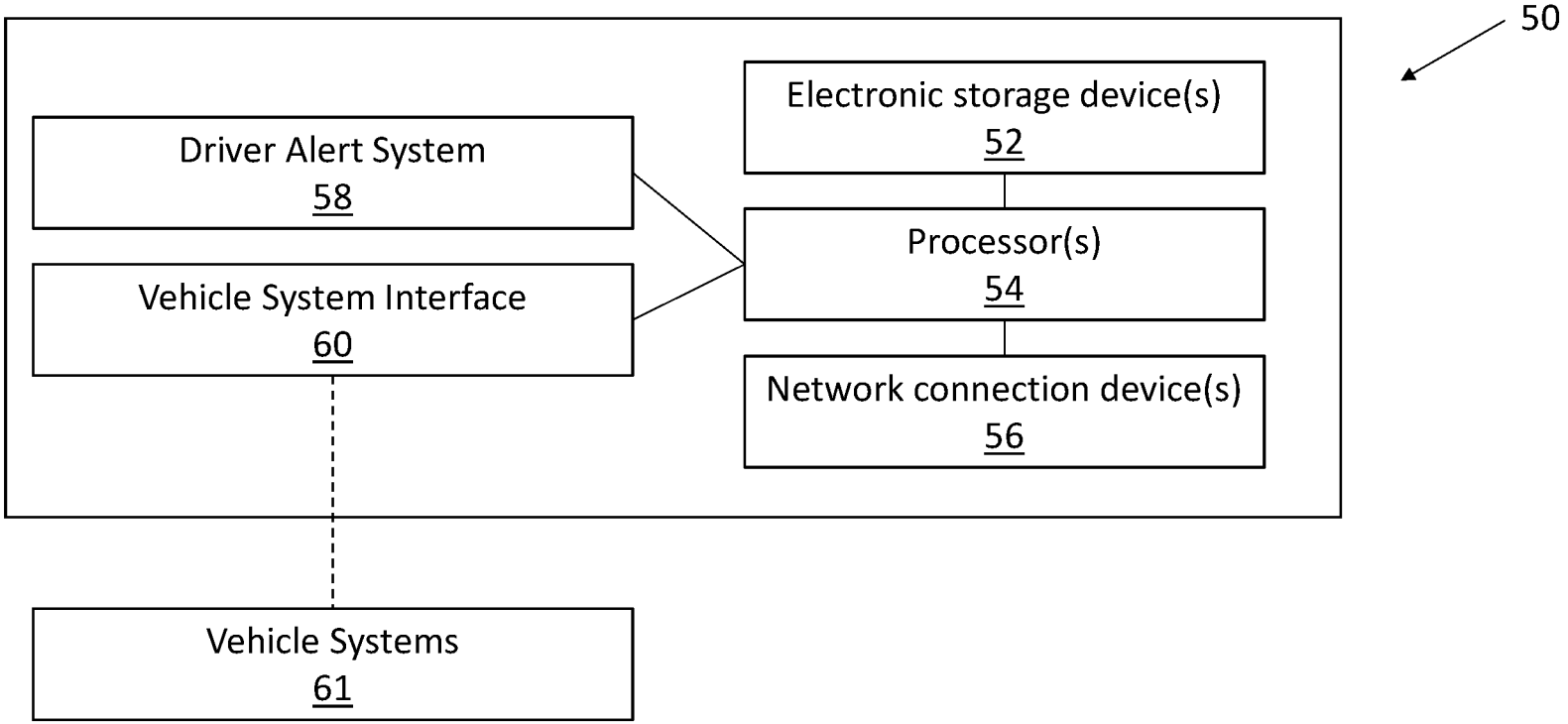
FIG. 6 is a simplified illustration of an exemplary vehicle-based system.

FIG. 6 is a simplified illustration of an exemplary vehicle-based system 50. The vehicle-based system 50 may be located at a vehicle 70. For example, without limitation, the vehicle-based system 50 may comprise a vehicle's 70 onboard computer system, may interface with the same, combinations thereof, or the like. The vehicle-based system 50 may comprise one or more processors 54. The vehicle-based system 50 may comprise one or more electronic storage devices 52. The one or more electronic storage devices 52 may comprise executable software instructions configured to provide some or all of the functionality shown and/or described herein when executed by one or more processors 54. The vehicle-based system 50 may comprise one or more network communication devices 56. The network communication devices 56 may comprise one or more wireless communication devices configured for near field and/or far reaching wireless communication, such as but not limited to, wi-fi, RFID, Bluetooth® protocol devices, cellular networks, internet communication, intranet communication, communication over the world wide web, combinations thereof, or the like. The processor(s) 54 may be in electronic communication with one or more driver alert systems 58 and/or vehicle system interface 60. In exemplary embodiments, the vehicle system interface 60 may be in electronic communication (wired or wireless) with, or mechanically connected to, one or more vehicle systems 61. Such vehicle systems 61 may include, for example without limitation, an acceleration system, a braking system, a transmission, and/or one or more sensors (e.g., accelerometer, speedometer, tachometer, proximity sensors, cameras, combinations thereof, or the like) for the vehicle 70. The driver alert systems 58 may comprise one or more devices configured to provide visual and/or audible alerts to the driver. A number of such vehicle-based systems 50 may be utilized, each of which may be located at a given one of a number of vehicles 70.

Figure 7A:
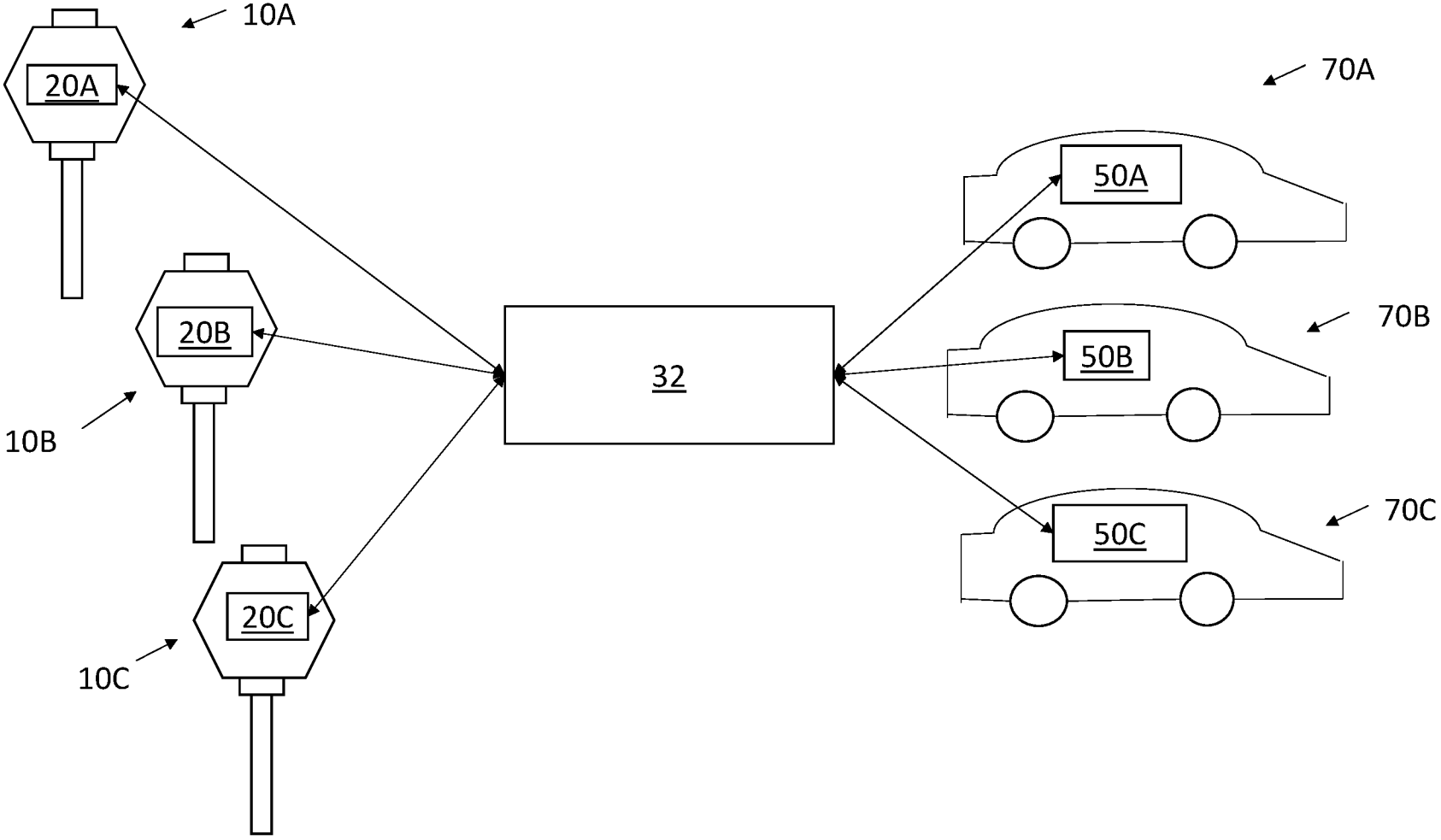
FIG. 7A is a simplified illustration of an exemplary system for providing signaling to multiple vehicles with the vehicle-based system of FIG. 6.

FIG. 7A is a simplified illustration of an exemplary system for providing signaling to vehicles 70A, B, C. Some or all vehicles 70A, B, C may comprise one of the vehicle-based systems 50A, B, C. Each vehicle-based system 50A, B, C may be configured to electronically receive the wait or proceed signals from the command center 32. Such wait or proceed signals may be also communicated from the command center 32 to the various controllers 20A, B, C of assemblies 10A, B, C. For example, without limitation, the command center 32 may determine which vehicle 70A, B, C should proceed first, such as but not limited to, in accordance with the disclosures shown and/or provided herein, and a command to provide a proceed signal may be sent to both an appropriate one of the vehicle-based system 50A, B, C and the associated assembly 10A, B, C. A command to provide a wait signal may be transmitted from the command center 32 to remaining ones of the vehicle-based system 50A, B, C and the associated assemblies 10A, B, C for an intersection. The commands transmitted may be sent at the same time and in the same format, or may be sent separately and/or in a different format.

Figure 7B:
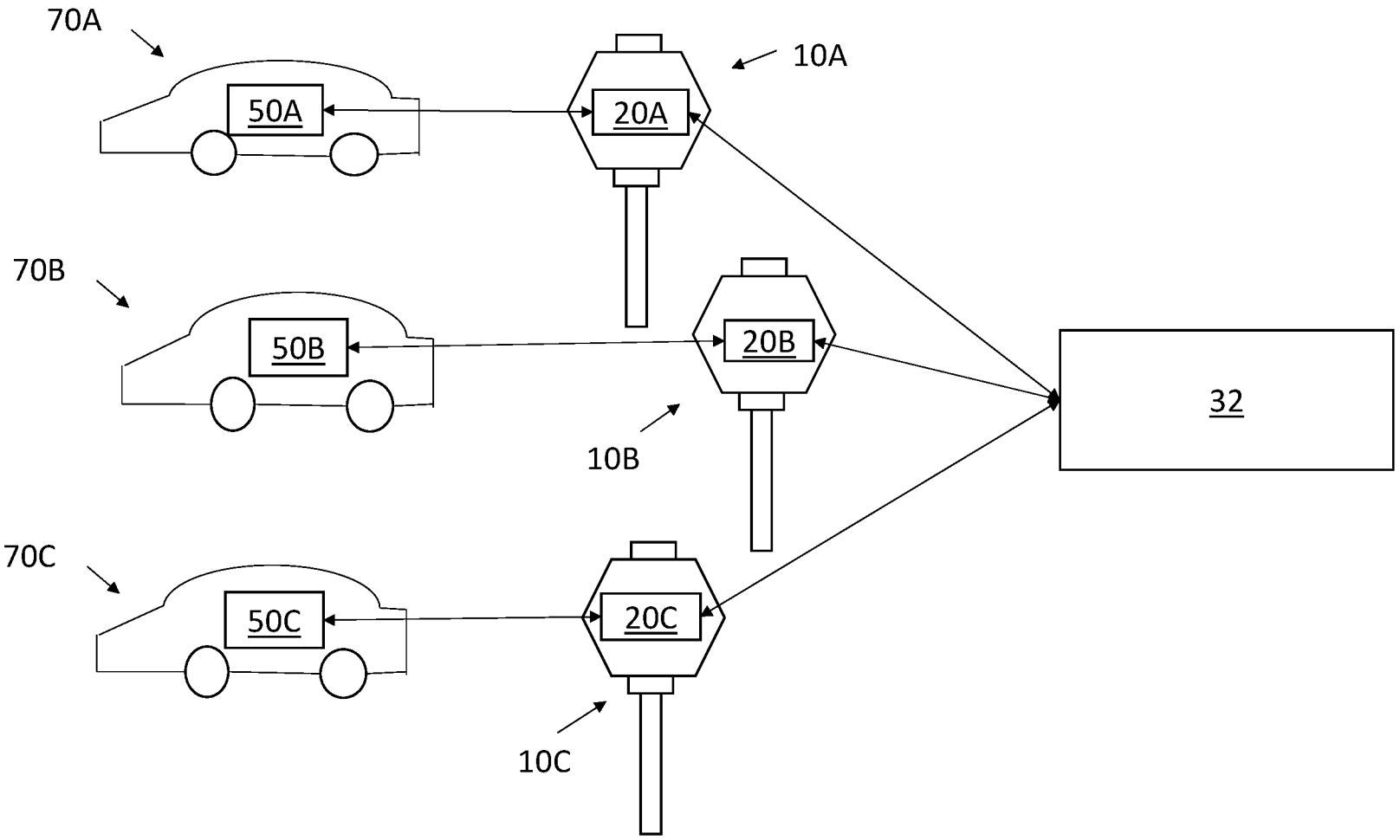
FIG. 7B is a simplified illustration of another exemplary system for providing signaling to multiple vehicles with the vehicle-based system of FIG. 6.

FIG. 7B is a simplified illustration of another exemplary system for providing signaling to vehicles 70A, B, C. In the illustrated embodiment, communication between the vehicle-based systems 50A, B, C may flow through the controllers 20A, B, C of the assemblies 10A, B, C. For example, without limitation, the commands to provide wait or proceed signals may be first sent from the command center 32 to the controllers 20A, B, C of the assemblies 10A, B, C. Following receipt, the assemblies 10A, B, C, may relay such the same or similar commands to the vehicle-based system 50A, B, C of the vehicles 70A, B, C.

In exemplary embodiments, upon arrival of a vehicle 70 having one of the vehicle-based systems 50, the adjacent assembly 10, may detect the arrival of the vehicle 70. Such detection may be made by way of the vehicle detection device 19 for the assembly 10. Identifying information, such as but not limited to a unique identifier for the vehicle 70, may be transmitted from the vehicle-based system 50 to the command center 32 and/or the assembly 10, such as by way of the network communication device 56 to the vehicle detection device 19 and/or the network connection device 26. The command center 32 and/or the assemblies 10, such as but not limited to by way of the network communication device 56 to the vehicle detection device 19 and/or the network connection device 26, may transmit commands to provide a wait or proceed signal to the vehicle-based systems 50. Alternatively, or additionally, the assemblies 10, such as by way of the vehicle detection devices 19 and/or network connection device 26, may broadcast appropriate commands to a respective signaling range to be picked up by any vehicle-based system 50 in sufficient proximity to the assembly 10. Alternatively, or additionally still, the command center 32 may broadcast appropriate commands within a signaling range, such as by way of the network communication devices 42 with the identifiers for the vehicles, to be picked up by any vehicle-based system 50 in sufficient proximity to the command center 32.

In exemplary embodiments, the assemblies 10, or the vehicle detection device 19 in particular, may comprise a combination of sensors or communications devices such that traffic signaling may be accomplished both for vehicles 70 equipped with the vehicle-based system 50 and those which are not. For example, without limitation, the vehicle detection device 19 may comprise both a near field communication device and a camera. Where the camera detects a vehicle 70 but no identifier is received at the near field communication device, the arrival time of the vehicle 70 may be documented and the traffic signal of the traffic signaling device 16 may be adjusted accordingly in accordance with the exemplary techniques shown and/or described herein. Where the camera detects a vehicle 70 and/or an identifier is received at the near field communication device, the arrival time of the vehicle 70 may be documented with the identifier and the traffic signal of the traffic signaling device 16 may be adjusted accordingly in accordance with the exemplary techniques shown and/or described herein.

Identifiers for multiple vehicles 70, each having one of the vehicle-based systems 50, may be received at one or more of the assemblies 10 and passed to the command center 32 for determining which assembly 10 and vehicle 70 to signal to proceed in accordance with any of the exemplary techniques shown and/or described herein. Any type of kind of identifier for any number of vehicles 70, each having a same or different one of the vehicle-based systems 50, at any number of assemblies 10 may be received and processed at the command center 32 for one, or any number of intersections.

In other exemplary embodiments, the identifier may not be required. Instead, for example without limitation, a signal indicating proceed or wait may be sent by the vehicle detection device 19 associated with the assembly 10 for which the wait or proceed signal has been received from the command center for receipt by any vehicle-based systems 50 within signaling range of the vehicle detection devices 19. The signaling range of the vehicle detection devices 19 may be configured to reach only those vehicles 70 stopped adjacent to the assembly 10.

Figure 8:
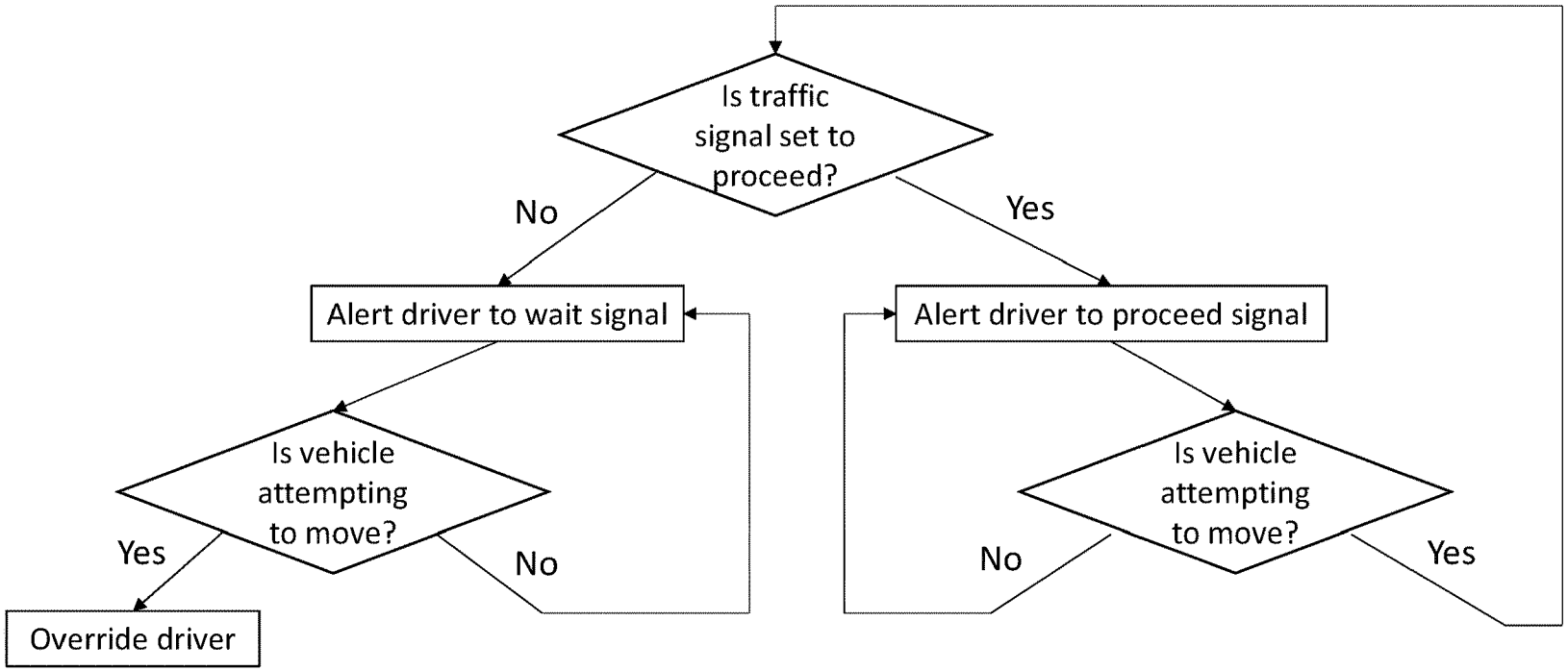
FIG. 8 is a flow chart with exemplary logic for operating the vehicle-based system of FIGS. 6-7B.

FIG. 8 is a flow chart with exemplary logic for operating the vehicle-based systems 50. If the vehicle-based system 50 receives a wait signal from the command center 32, the vehicle-based systems 50 may be configured to alert the driver to the wait signal.

If the vehicle-based system 50 has received a wait signal and the vehicle system interface 60 indicates that the driver is attempting to move the vehicle 70, the vehicle system interface 60 may override the driver's commands and stop the vehicle 70 from moving. For example, without limitation, the vehicle system interface 60 may detect attempted movement where the braking system indicates a decrease or release of applied brakes, applications of a clutch, an increase in applied acceleration, a shift into drive, combinations thereof, or the like. For example, without limitation, the vehicle system interface 60 may cease vehicle 70 movement by applying or increasing braking at the braking system, decrease or cease the application of acceleration at the acceleration system, shift the transmission (e.g., into neutral, a lower gear, or park), combinations thereof, or the like. Alternatively, or additionally, the same or additional alerts may be transmitted to the driver at the driver alert systems 58. Examples of such further alerts including flashing lights, increasing illumination, playing an audible recording, replaying the audible recording, replaying the audible recording at a higher volume, displaying a message, redisplaying the same message or displaying a new message, combinations thereof, or the like.

If the vehicle-based system 50 receives a proceed signal from the command center 32, the vehicle-based systems 50 may be configured to alert the driver to the proceed signal. If the driver does not attempt to move the vehicle 70, such as within a predetermined period of time following alert of the proceed signal, one or more further alerts may be provided. Examples of such further alerts including flashing lights, increasing illumination, playing an audible recording, replaying the audible recording, replaying the audible recording at a higher volume, displaying a message, redisplaying the same message or displaying a new message, combinations thereof, or the like. Detection of movement, or lack thereof, may be made by way of the vehicle system interface 60. Detection of attempted movement may be made, for example without limitation, by releasing of brakes, application of acceleration, applications of a clutch, shifting transmission (e.g., into drive, a low gear), combinations thereof, or the like.

Figure 9A:
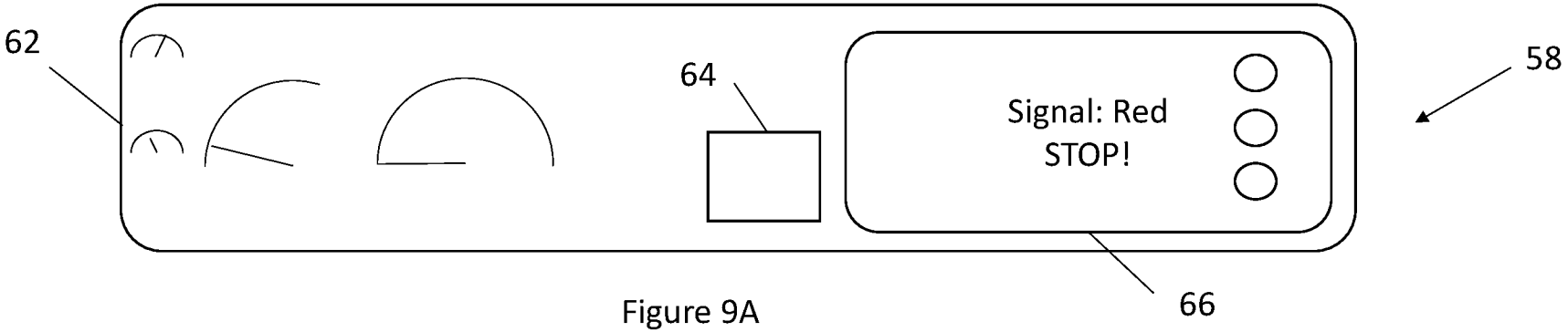
FIG. 9A is an exemplary dashboard with an exemplary display for the vehicle-based system of FIG. 6 with an exemplary wait signal.
Figure 9B:
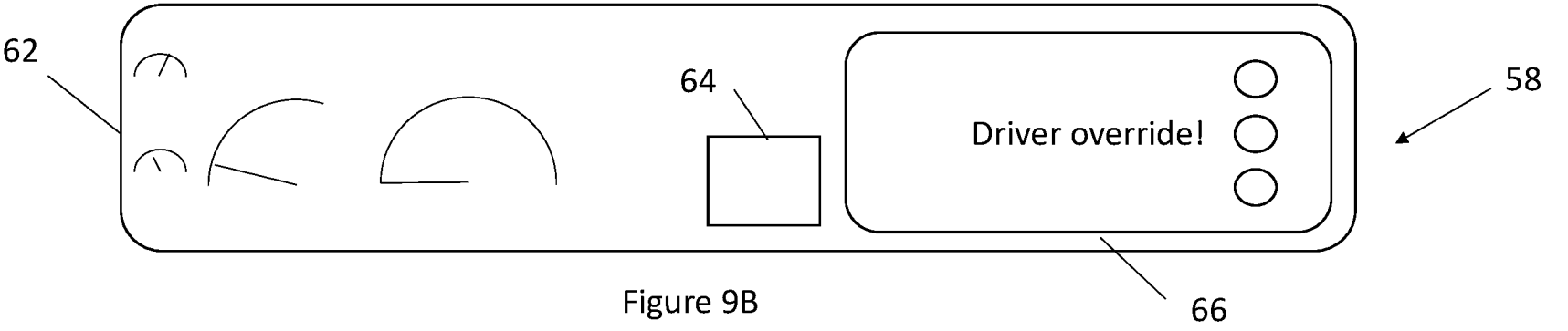
FIG. 9B is the exemplary dashboard of FIG. 9A with an exemplary override signal.
Figure 9C:
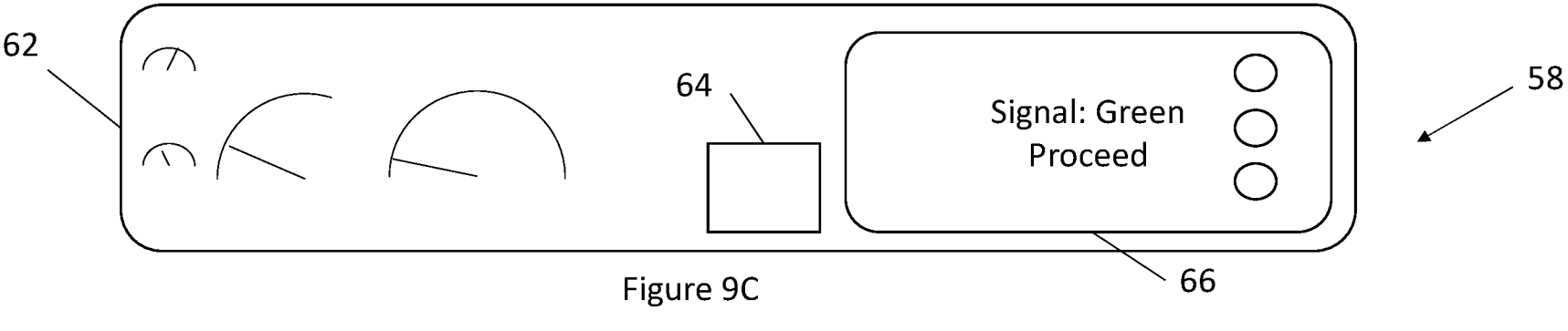
FIG. 9C is the exemplary dashboard of FIG. 9A with an exemplary proceed signal.

FIG. 9A through FIG. 9C illustrate an exemplary dashboard 62 for an exemplary vehicle 70 with an exemplary driver alert system 58 integrated with the dashboard 62. The driver alert system 58 may comprise one or more electronic displays 66 configured to visually display messages, speakers 64 configured to provide audible messages, lights, combinations thereof, or the like. While illustrated as located at the dashboard 62, the driver alert system 58, or components thereof, may alternatively or additionally be located elsewhere in the vehicle 70, such as standalone displays, integrated with other vehicle 70 speakers, combinations thereof, or the like. The driver alert systems 58 may be the same or different across different types of vehicles 70.

As illustrated for example, without limitation, at FIG. 9A, where the vehicle-based system 50 of a vehicle 70 receives a wait signal, a visual depiction of such a signal may be displayed at the electronic display(s) 66 of the driver alert system 58. The visual depiction of the wait signal may comprise a red light, a traffic light with the red light illuminated, a stop sign, the traffic signaling device 16, the one or more signaling devices 18A, 18B, text (e.g., "stop", "wait", "red light", combinations thereof, or the like), combinations thereof, or the like. Alternatively, or additionally, an audible alert such as a recording of the words, "stop", "wait", "red light", combinations thereof, or the like, may be played through the speaker(s) 64. As another example, without limitation, one or more not necessarily colorized lights may be illuminated.

As illustrated for example, without limitation, at FIG. 9B, where the vehicle-based system 50 of a vehicle 70 that has received a wait signal also receives an indication that the driver is attempting to move the exemplary vehicle 70, the driver alert system 58 may display a visual communication at the electronic display(s) 66 to the driver that the driver's commands are being overridden, such as but not limited to, by flashing a red light, displaying the words "driver override" or similar, and/or an audible alert such as a recording of the words "driver override" may be played through the speaker(s) 64. As another example, without limitation, one or more not necessarily colorized lights may be illuminated.

As illustrated for example, without limitation, at FIG. 9C, where the vehicle-based system 50 of a vehicle 70 receives a signal to proceed, a visual depiction of the proceed signal may be provided at the electronic display(s) 66 of the driver alert system 58. The visual depiction may comprise a green light, a traffic light with a green light illuminated, removal of a stop sign graphic, the traffic signaling device 16, the one or more signaling devices 18A, 18B, text (e.g., "proceed", "go", "green light", combinations thereof, or the like), combinations thereof, or the like. Alternatively, or additionally, an audible alert such as a recording of the words, "proceed", "go", "green light", combinations thereof, or the like, may be played through the speaker(s) 64. As another example, without limitation, one or more not necessarily colorized lights may be illuminated.

Figure 10:
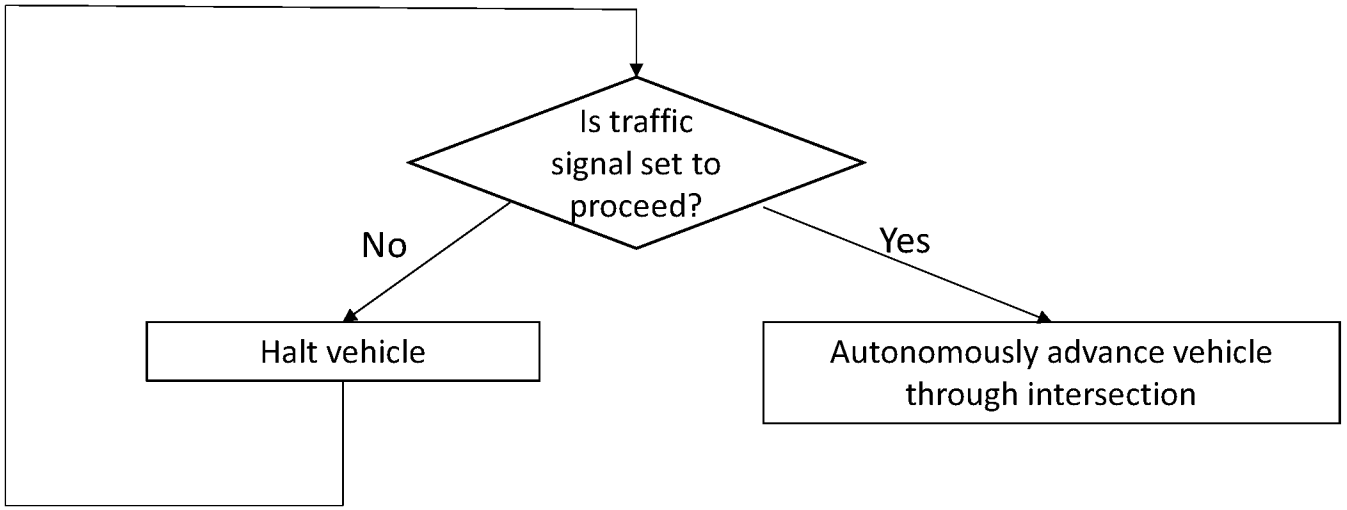
FIG. 10 is a flow chart with other exemplary logic for operating the vehicle-based system of FIGS. 6-7B.

FIG. 10 is a flow chart with exemplary logic for operating at least partially autonomous vehicles 70 with the assemblies 10 and/or command center 32. Where a proceed signal is received at the vehicle-based system 50 associated with a given one of the assemblies 10 to which a proceed signal is and/or has been transmitted, the vehicle system interface 60 may command certain vehicle systems 61 to, partially or fully, autonomously advance the vehicle 70 through the intersection. Such advancement may include, for example without limitation, release of the braking system, application of acceleration systems, shifting into drive or another gear, control of the steering, combinations thereof, or the like. Where a wait signal is received at the vehicle-based system 50 associated with a given one of the assemblies 10 to which a wait signal has been transmitted, the vehicle system interface 60 may command certain vehicle systems 61 to halt movement of the vehicle 70. Such halting may include, for example without limitation, application of the braking system, deactivation of the accelerator systems, shifting into park, neutral, or other gear, combinations thereof, or the like. Such autonomous vehicle control may be accomplished using one or more proximity sensors, cameras, known or yet to be developed autonomous vehicle control systems.

In exemplary embodiments, without limitation, such vehicle 70 operation may be performed without regard to transmission of signals to/from the assemblies 10. For example, without limitation, such signals for halting and/or advancing vehicles 70 may be sent directly from the command center 32 to the vehicle-based systems 50.

Figure 11:
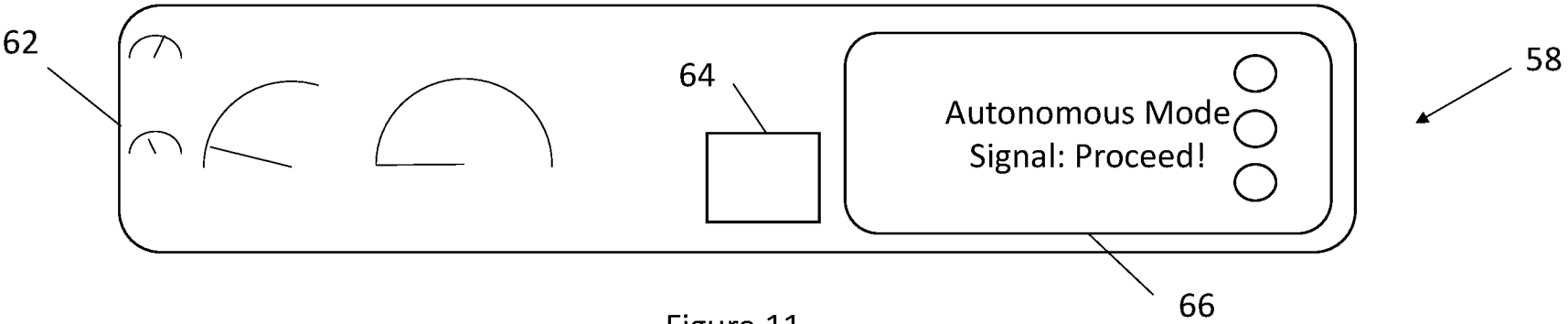
FIG. 11 is the exemplary dashboard of FIG. 9A with an exemplary autonomous mode signal.

As illustrated in FIG. 11, the one or more driver alert systems 58 may be configured to display and/or provide an audible message, such as at the one or more electronic display 66 and/or speakers 64 respectively, a message that the vehicle 70 is operating in an autonomous control mode.

Figure 12:
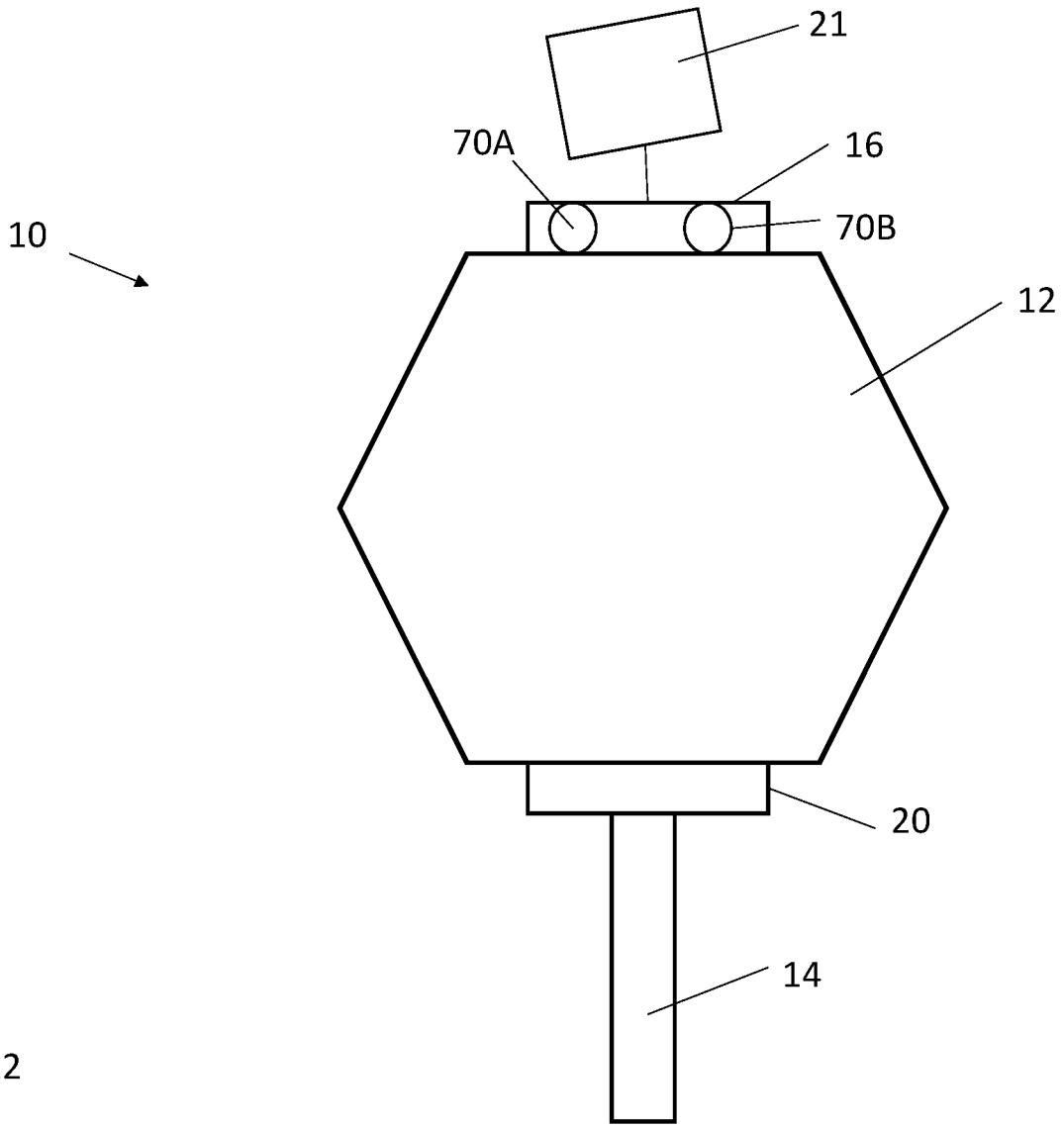
FIG. 12 is a rear view of another exemplary assembly in accordance with the present invention.

FIG. 12 illustrates another exemplary embodiment of the assembly 10'. The assembly 10' may comprise some or all of the same components or other features of the assembly 10 shown and described with respect to FIGS. 1-11, though such is not required.

The assembly 10' may comprise one or more cross-traffic vehicle detection devices 72. The cross-traffic vehicle detection devices 72 may be configured to detect the presence or non-presence of vehicles at the intersection 36 or within an area 74. The area 74 may comprise a predetermined area of or about the intersection. The area 74 may be a predefined distance from the cross-traffic vehicle detection devices 72, a predetermined size or shape, or the like. The area 74 may include some or all of an area of the intersection 36 located rearward of the assembly 10'.

The cross-traffic vehicle detection devices 72 may be configured to continuously or periodically scan the area 74. The cross-traffic vehicle detection devices 72 may be positioned on one or more rear portions of the traffic signaling device, the controller 20, the stop sign 12, the mounting device 14, combinations thereof, or the like. The cross-traffic vehicle detection devices 72 may be the same or different from the vehicle detection devices 19. For example, without limitation, the cross-traffic vehicle detection devices 72 may comprise the same or different components as the vehicle detection devices 19, may be calibrated differently, combinations thereof, or the like.

For example, without limitation, the cross-traffic vehicle detection devices 72 may comprise cameras, radar, lasers, motion detectors, light sensors, audio sensors, ultrasound sensors, infrared sensors, weight sensors, metal detectors, image recognition software, proximity detectors, combinations thereof, or the like. Alternatively, or in addition, the cross-traffic vehicle detection devices 72 may comprise wireless communication devices such as, but not limited to, wi-fi, cellular network connectivity devices, internet connectivity devices, radio transmitters/receivers, network adapters, combinations thereof, or the like, and/or near field communication devices, such as but not limited to, RFID, Bluetooth®, combinations thereof or the like. The cross-traffic vehicle detection devices 72 may be configured to receive signals from devices installed in vehicles 70 within signaling range of such the cross-traffic vehicle detection devices 72. The cross-traffic vehicle detection devices 72 may be mounted to the assembly 10'. However, in other exemplary embodiments, the cross-traffic vehicle detection devices 72 may instead be located in close proximity with the assembly 10'.

A single or multiple cross-traffic vehicle detection device 72 may be installed at, or in association with, a given assembly 10'. Where multiple cross-traffic vehicle detection devices 72 are so utilized, they may be of the same or different type. The cross-traffic vehicle detection devices 72 may be in electrical communication with the controller 20 and/or the traffic signaling device 16.

Figure 13:
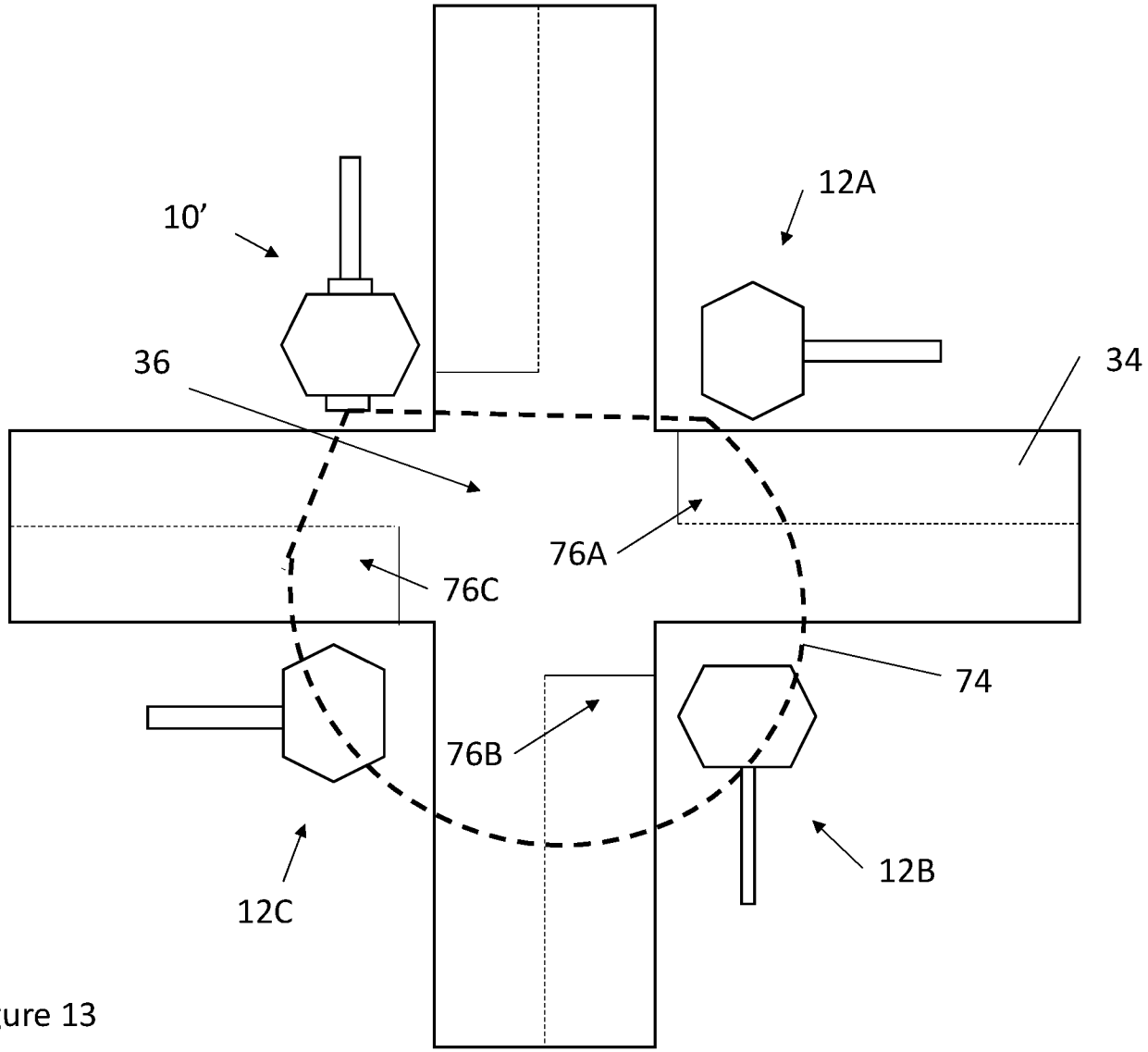
FIG. 13 is a top plan view of the intersection of FIG. 3 with the assembly of FIG. 12 installed.

FIG. 13 illustrates the assembly 10' installed at the exemplary four-way intersection 36. An exemplary area 74 for the cross-traffic vehicle detection devices 72 is provided which covers a remaining three stop areas 76A, 76B, 76C associated with a remaining three stop signs 12A, 12B, 12C. As illustrated and further described herein, the assembly 10' may permit the use of a single one, or multiple, of the assemblies 10' at a given intersection 36 with standard stop signs 12A, 12B, 12C at some or all of the other intersection areas. For example, without limitation, as a vehicle 70 approaches the assembly 10', the assembly 10' may monitor for vehicles 70 within the area 74, which coincides with the stop areas 76A, 76B, 76C associated with the remaining stop signs 12A, 12B, 12C. If the area 74 is occupied, the traffic signal device 16 of the assembly 10' may be set to wait. If the area 74 is unoccupied, the traffic signal device 16 of the assembly 10' may be set to proceed.

Figure 14:
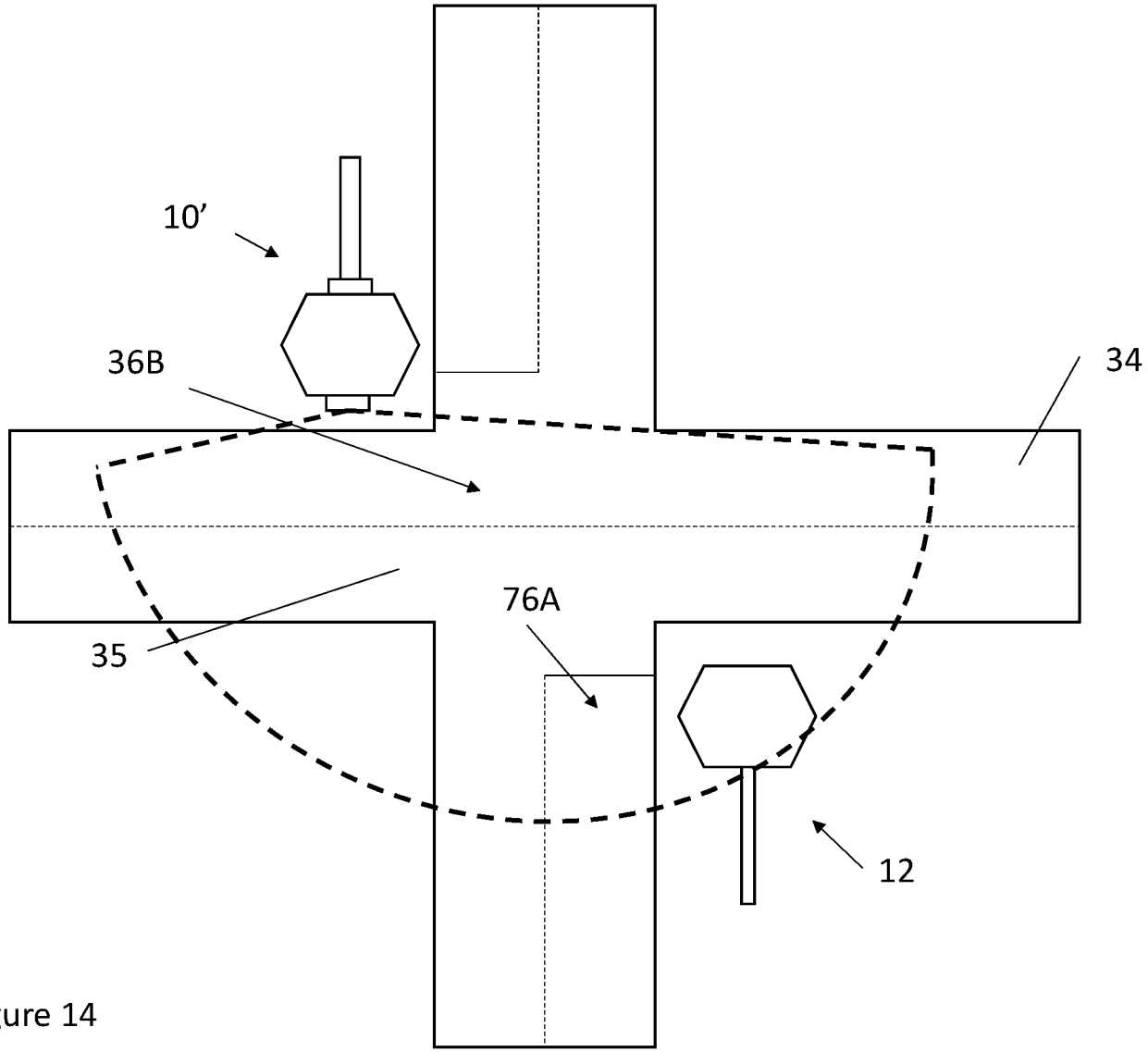
FIG. 14 is a top plan view of another exemplary intersection with the assembly of FIG. 12 installed.

FIG. 14 provides an illustration of the assembly 10' at a two-way intersection 36B. The area 74 may cover the stop area 76A of an opposing stop sign 12 and/or a portion of the roadway not associated with stop signs 12. In this way, the assembly 10' may be used with roads where not all portions of the intersection have a stop sign, and/or with intersections that have stop signs 12 rather than assemblies 10 or 10'. The assembly 10' may be configured to monitor the area 74 rearward of the assembly 10' to properly signal traffic based on detection or non-detection of vehicles 70 within the area 74. One or more of the assemblies 10' may be used at any type or kind of intersection 36.

Figure 15:
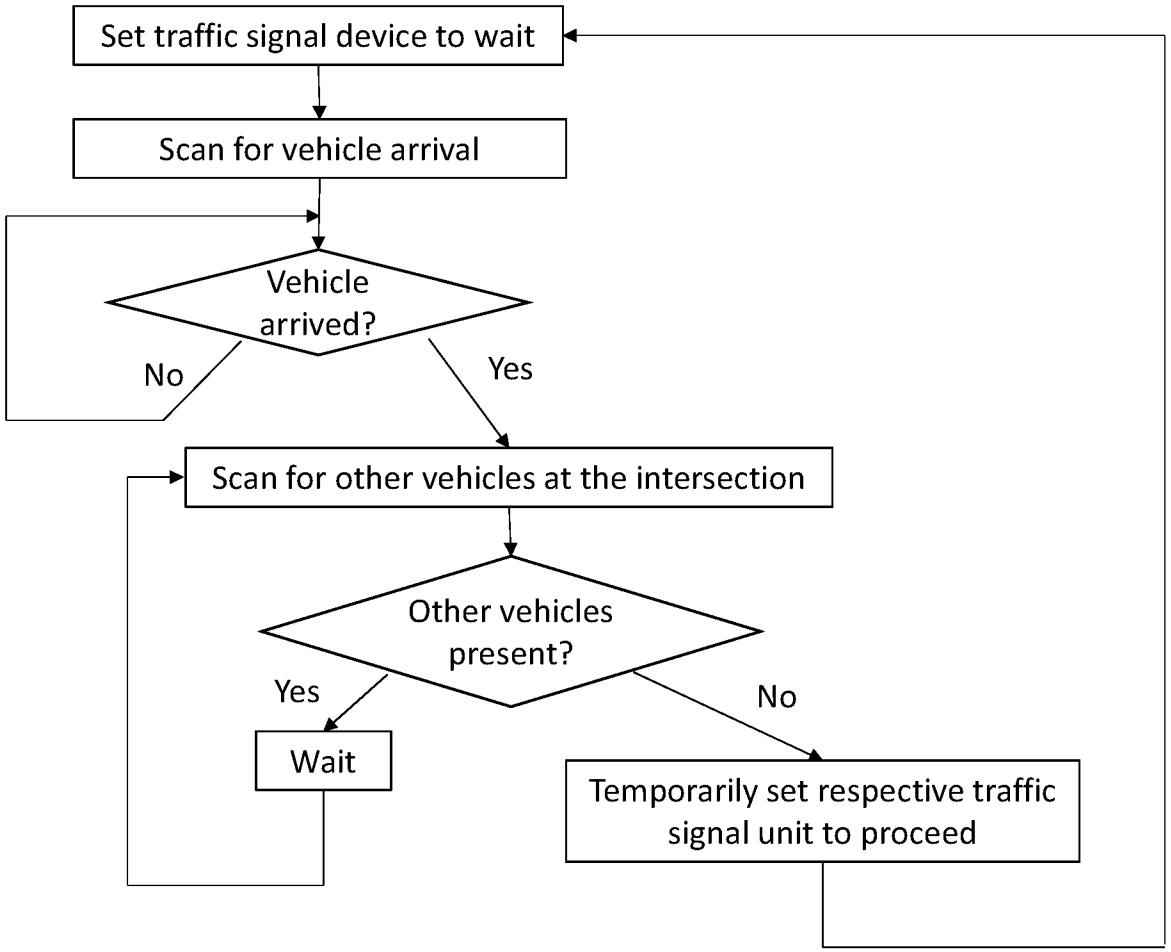
FIG. 15 is a flow chart with exemplary logic for operating the assembly of FIG. 12 at intersections, such as the intersections of FIGS. 13-14.

FIG. 15 illustrates exemplary logic for operating the assembly 10'. The traffic signal device 16 of the assembly 10' may be set to wait. The assembly 10', such as by way of the vehicle detection device 19, vehicle-based system 50, combinations thereof, or the like, may monitor for the arrival of a vehicle 70 at the assembly 10'. If no such vehicle 70 is detected, the assembly 10' may continuously or periodically check for such vehicles 70. If a vehicle 70 is detected, the assembly 10' may check for other vehicles 70 at the intersection 36 within the area 74, such as but not limited to, by way of the cross-traffic vehicle detection devices 72. Where no other vehicles 70 are found within the area 74, the traffic signal device 16 may be temporarily set to proceed to signal the vehicle 70 at the assembly 10' to proceed. For example, without limitation, the traffic signal 16 may provide the proceed signal for a predetermined period of time, such as may be sufficient for the vehicle 70 at the assembly 10' to proceed, and may reset in time to signal any vehicles located or arriving there behind to wait. Where one or more other vehicles 70 are detected, the traffic signaling device 16 may continue to be set at proceed at the assembly 10' and may periodically or continuously rescan for vehicles 70 within the area 74.

Alternatively, or additionally, detection of vehicles 70 within the area 74 may be used as confirmation that a vehicle 70 has proceeded through the intersection 36.

The assembly 10' may be used by itself at an intersection 36. However, the assembly 10' may be used in conjunction with other such assemblies 10' and/or 10. Communication between such assemblies 10' and/or 10 may be provided, such as but not limited to, by way of the command center 32, though such is not required. Where more than one assembly 10' is used, the assemblies 10' may be in communication with a command center 32 and may additionally utilize the logic shown and/or described herein, such as but not limited to, with respect to FIG. 5. Furthermore, where vehicle-based systems 50 are used, the assembly 10 or assemblies 10' may be in communication with a command center 32 and may additionally utilize the logic shown and/or described herein, such as but not limited to, with respect to FIGS. 8 and/or 10.

The assemblies 10' and/or 10 may be used with any type or kind of intersection 36. The size and shape of the areas 74 shown and/or described herein are merely exemplary and not intended to be limiting. Any size and/or shape area 74 may be utilized, such as but not limited to, by selection of type, kind, number, and/or location of sensors, calibration, power, combinations thereof, or the like. In exemplary embodiments, the assemblies 10' may be calibrated or otherwise programmed such that the area 74 extends to cover at least a portion of any areas of the intersection 36 not having a stop indicator (e.g., where crossing traffic does not have to stop) and stop areas of any areas of the intersection 36 utilizing stop signs 12 not having the traffic control features of the present invention (e.g., a conventional stop sign).

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing devices. The electronic devices may be personal computers, smartphones, tablets, databases, servers, or the like. The electronic connections and transmissions described herein may be accomplished by wired or wireless means.

What is claimed is:

1. A traffic control system comprising:

a stop sign;

a traffic signaling device associated with the stop sign and configured to selectively provide a wait and a proceed signal;

a vehicle detection device configured to monitor a first area forward or adjacent to the stop sign;

a number of vehicle control systems, each located in one of the vehicles and configured to control movement of said one of said vehicles, wherein each of the number of vehicle control systems is in selective electronic communication with the controller; and a cross-traffic vehicle detection device configured to monitor a second area rearward of the stop sign;

a controller configured to:

receive data from the vehicle detection device indicating a presence or non-presence of vehicles within the first area;

receive data from the cross-traffic vehicle detection device indicating a presence or non-presence of vehicles within the second area;

where data is received indicating the presence of at least one vehicle within the first area and the non-presence of any vehicles within the second area, command the traffic signaling device to temporarily cease providing the wait signal; and upon receipt of the data indicating the presence of a first one of the vehicles within the first area, receipt of the data from the cross-traffic vehicle detection device indicating the presence of a second one of the vehicles in the second area, and receipt of data from a first one of the number of vehicle control systems provided at the first one of the vehicles indicating movement of the first one of the vehicles out of the first area and into the second area, indicate a cross-traffic hazard to the first one the number of vehicle control systems;

wherein each of said the number of vehicle control systems are configured to operate said one of said vehicles to slow or cease movement into said second area following receipt of said cross-traffic hazard indication.

2. The traffic control system of claim 1 further comprising:

a mounting device configured for placement adjacent to a stop area of an intersection.

3. The traffic control system of claim 2 wherein:

said mounting device comprises a pole, wherein said stop sign is mounted at an elevated position on said pole.

4. The traffic control system of claim 3 further comprising:

a solar panel mounted to said pole and electrically connected to said traffic signaling device, the vehicle detection device, and the cross-traffic vehicle detection device.

5. The traffic control system of claim 1 wherein:

said vehicle detection device is provided at a front side of said stop sign; and said cross-vehicle detection device is provided at a rear side of said stop sign.

6. The traffic control system of claim 5 wherein:

said cross-traffic vehicle detection device is provided at a common housing with said traffic signaling device.

7. The traffic control system of claim 1 wherein:

said traffic signaling device comprises a red light and a green light.

8. The traffic control system of claim 1 wherein:

said vehicle detection device comprises a proximity sensor; and said cross-traffic vehicle detection device comprises another proximity sensor.

9. The traffic control system of claim 8 wherein:

said proximity sensor of said vehicle detection device comprises one or more weight sensors or metal detectors; and said proximity sensor of said cross-traffic vehicle detection device comprises at least one ultrasonic sensor.

10. The traffic control system of claim 1 wherein:

said vehicle detection device comprises a near field communication device; and said cross-traffic vehicle detection device comprises a proximity sensor.

11. The traffic control system of claim 1 wherein:

said vehicle detection device comprises a wireless communication device configured to wirelessly communicate with any vehicle-based systems within a signaling range of the wireless communication device.

12. The traffic control system of claim 1 wherein:

said vehicle detection device comprises a wireless communication device configured to wirelessly communicate with a command center remote from said stop sign.

13. The traffic control system of claim 1 wherein:

said controller is configured to, after providing said command to the traffic signaling device to temporarily provide the proceed signal, monitor for data from said cross-traffic vehicle detection device indicating the presence of the vehicle within the second signaling area to confirm that the vehicle signaled to proceed did proceed.

14. A system for controlling traffic at an intersection, said system comprising:

a number of traffic control devices, each associated with one of a number of stop areas of said intersection and comprising:

a stop sign;

a traffic signaling device configured to selectively provide a wait and a proceed signal;

a vehicle detection device configured to monitor a first area forward or adjacent to the stop sign;

a cross-traffic vehicle detection device configured to monitor a second area rearward of the stop sign; and a controller in electronic communication with the traffic signaling device, the vehicle detection device, and the cross-traffic vehicle detection device, wherein said controller is configured to:

cause said traffic signaling device to normally provide the wait signal;

receive data from the vehicle detection device indicating a presence of non-presences of one or more vehicles within the first area;

following receipt of data indicating at least one vehicle within the first area, cause the cross-traffic vehicle detection device to check the second area for a presence or non-presence of one or more vehicles;

following receipt of data from the cross-traffic vehicle detection device indicating the non-presence of any vehicles within the second area, command the traffic signaling device to temporarily provide the proceed signal instead of the wait signal;

each of said number of traffic control devices comprise a timing device;

said controller is configured to electronically record an arrival time determined by said timing device following receipt of the data from the vehicle detection device indicating the vehicle within the first area; and said controller is configured to electronically transmit said arrival time to a command center remote from, but in electronic communication with, each of the number of traffic control devices;

said command center is configured to:

electronically receive said arrival times from said number of traffic control devices;

determine an earliest one of said received arrival times; and command a respective one of said number of traffic control devices from which said earliest one of said received arrival times is received to temporarily set said traffic signaling device to proceed.

15. The system of claim 14 wherein:

each of said controllers of each of said number of traffic control devices is configured to, after setting said traffic signaling device to proceed, monitor for data from said cross-traffic vehicle detection device indicating the presence of a vehicle within the second area, and electronically transmit confirmation of the vehicle proceeding to the command center.

16. A method for controlling traffic at an intersection, said method comprising the steps of:

commanding a traffic signaling device associated with a stop sign and associated with a stop area of the intersection to provide a wait signal;

electronically receiving data from a vehicle detection device associated with the stop sign indicating a vehicle within a first area forward of the stop sign;

electronically receiving data from a cross-traffic vehicle detection device associated with the stop sign indicating a presence of one or more vehicles within a second area rearward of the stop sign;

commanding the traffic signaling device to continue providing the wait signal;

electronically receiving data from the cross-traffic vehicle detection device indicating a non-presence of any vehicles within the second area; and commanding the traffic signaling device to temporarily provide a proceed signal;

electronically receiving data from the vehicle detection device associated with the stop sign indicating a second vehicle within the first area forward of the stop sign;

electronically receiving data from the cross-traffic vehicle detection device associated with the stop sign indicating a presence of a third vehicle within the second area rearward of the stop sign;

commanding the traffic signaling device to provide the wait signal;

electronically receiving data from a vehicle control system of the second vehicle indicating movement or intended movement of the second vehicle; and electronically commanding, by way of the vehicle control system of the second vehicle, to cease movement or not permit movement of the second vehicle.

17. The method of claim 16 further comprising the steps of electonically receiving data from the cross-traffic vehicle detection device indicating a presence of the vehicle within the second area confirming that the vehicle proceeded from the stop area; and commanding the traffic signaling device to cease providing the proceed signal.

18. The method of claim 16 wherein: said data is received at a command center remote from the stop sign.

19. The system of claim 14 further comprising: a number of vehicle control systems, each located in one of the vehicles and configured to control movement of said one of said vehicles, wherein each of the number of vehicle control systems is in selective electronic communication with the controller, and wherein said controller is configured to, upon receipt of the data including the presence of a first one of the vehicles within the first area, receipt of the data from the cross-traffic vehicle detection device indicating the presence of a second one of the vehicles in the second area, and receipt of data from a first one the number of vehicle control systems provided at the first one of the vehicles indicating movement of the first one of the vehicles out of the first area and into the second area, indicate a cross-traffic hazard to the first one of the number of vehicle control systems, and wherein each of said the number of vehicle control systems are configured to operate said one of said vehicles to slow or cease movement into said second area following receipt of said cross-traffic hazard indication.

* * * * *